US006285274B1

(12) United States Patent
Gunchenko

(10) Patent No.: US 6,285,274 B1
(45) Date of Patent: Sep. 4, 2001

(54) SPIRAL VARISTOR

(75) Inventor: Joseph Gunchenko, Lansdale, PA (US)

(73) Assignee: The Wiremold Company, Philadelphia, PA (US)

( * ) Notice: Subject to any disclaimer, the term of this patent is extended or adjusted under 35 U.S.C. 154(b) by 0 days.

(21) Appl. No.: 09/697,394

(22) Filed: Oct. 27, 2000

(51) Int. Cl.[7] ..... H01C 7/10; H01C 7/13
(52) U.S. Cl. ..... 338/21; 338/22 R
(58) Field of Search ..... 338/20, 21, 22 R, 338/25

(56) References Cited

U.S. PATENT DOCUMENTS 5,307,046 * 4/1994 Alim et al. ..... 338/21
5,770,993 * 6/1998 Miyazawa et al. ..... 337/160
5,998,299 * 12/1999 Krishnan ..... 438/694

FOREIGN PATENT DOCUMENTS 1-66901 * 3/1989 (JP) .

* cited by examiner

*Primary Examiner*—Karl D. Easthom
*Assistant Examiner*—Kyung S. Lee
(74) *Attorney, Agent, or Firm*—McCormick, Paulding & Huber LLP

(57) ABSTRACT

A metal oxide varistor comprises a ceramic substrate having a first and second surface that form a spiral, and first and second conductive coatings disposed thereon that are in electrical contact with respective electrodes. A cavity is defined between the conductive coatings to preclude shorting the device, and a non-conductive material is disposed in the cavity to prevent arcing.

7 Claims, 2 Drawing Sheets

SPIRAL VARISTOR

FIELD OF THE INVENTION

This invention relates to metal oxide varistors. More particularly, this invention relates to a novel configuration for such a varistor that greatly increases the current carrying capabilities over the disc or "hockey puck" shaped conventional varistors.

BACKGROUND OF THE INVENTION

Polycrystalline metal oxide varistors, commonly known as MOV's, are well known in the art. MOV's include metal electrodes separated by sintered ceramics comprising a variety of metal oxides, zinc oxide being the predominant ceramic with lesser quantities of other oxides added in, including but not limited to oxides of bismuth, manganese, cobalt, antimony and/or tin. The metal electrodes may be made of any conductive material and are typically disposed on opposed major surfaces of the ceramic substrate.

MOVs commonly have the geometry of a circular disc shape with a thickness that is much smaller than the radius of the disc. A generic embodiment of a prior art MOV is shown in FIG. 1, wherein a disc-shaped ceramic substrate 11 separates a circular shaped first electrode 14 from a circular shaped second electrode 17. Such disc-type MOV's are typically coated with a non-conductive material to prevent arcing between the electrodes about the cylindrical sides of the disc.

MOV's are often provided in electrical parallel within a parent electrical circuit. Current travels, if at all, from one electrode to the other through the ceramic substrate, which acts as a variable resistor (varistor). The principal advantage of MOV's is that the electrical conductivity of the ceramic substrate changes non-linearly with respect to the voltage applied. The voltage at which an MOV's electrical conductivity dramatically changes is referred to as the clamping or breakdown voltage. When the applied voltage is below the threshold, or clamping voltage of the MOV, the device acts as an open circuit and virtually does not conduct. When the device is electrically connected in parallel with a parent circuit, and an over-voltage condition occurs (as often happens during a surge), the voltage may rise well over the nominal operating voltage of equipment located in the parent circuit parallel to the MOV device(s). When this surge exceeds the clamping or breakdown voltage of the MOV device, the MOV's ceramic substrate will breakdown electrically creating a short circuit in parallel with the load or parent circuit; resulting in conduction of the surge away from the parent circuit and associated equipment. MOVs behave electrically much like two Zener diodes facing each other in a series. Like such an arrangement, MOVs are bi-directional.

The electrical properties of MOV's may be described by the following equation:

$$I=(V/C)^{\alpha}$$

where: I is the current through the MOV,

V is the voltage across the electrodes,

C is a constant dictated by the substrate material and its geometric configuration, and $\alpha$ is a constant for a particular range of current across the electrodes.

Regarding the constant C in the above equation, the clamping voltage of a particular MOV is a function of the thickness of the particular substrate material interposed between the electrodes. Thicker substrates exhibit higher clamping voltages. However, the amount of surge current that a particular MOV can effectively dissipate is also a function of the surface area of the electrode/substrate juncture. If the surge current is too great for this surface area, and for the mass of the varistor substrate, the device will be destroyed due to its inability to dissipate the surge energy and the high impedance that may be posed by the insufficient surface area of the electrode/substrate juncture. This destruction is often referred to as catastrophic failure. A condition known as thermal runaway may occur when the applied voltage to the MOV is higher than its clamping voltage. This will result in continuous, non-transient, steady state current to be conducted through the MOV, and hence extremely high temperatures of the ceramic substrate. While prior art MOV's encompass a wide variety of clamping voltages, many are limited in their ability to carry sufficient current. In order to carry higher currents, the diameter of disc-shaped MOVs must be increased. This is undesirable because of the extra space such an MOV would occupy in a circuit board for example. Thus, what is needed in the art is a metal oxide varistor of compact shape that can dissipate higher currents without undergoing catastrophic failure at relative applied currents.

SUMMARY OF THE INVENTION

The present invention comprises an MOV with significantly increased surface area per unit volume, thus yielding an MOV with a greater current carrying capability.

Specifically, the present invention includes an MOV having a generally cylindrical shape including a ceramic body with first and second major A surfaces of spiral shape separated by a non-conductive core. This shape increases the surface areas of the ceramic substrate. A first electrode is in contact with a first major surface and a second electrode is in contact with a second major surface of the spiral substrate. The first and second major surfaces are defined by a spiral shaped ceramic body designed to prevent arcing between the electrodes associated with said surfaces.

In the preferred embodiment, these major surfaces spiral away from a central point, which in three dimensions can be likened to a roll of double-sided tape or a jelly roll. The present invention is directed to MOVs having at least two surfaces that are substantially of spiral shape, and that need not be defined by a single equation. An alternative embodiment reverses the positions of the ceramic substrate and the non-conductive core material, requiring certain other modifications from the preferred embodiment. Such modifications are described herein.

The area of contact between the electrodes and the substrate material in each of the above-described embodiments is substantially increased on a unit volume basis as compared to prior art disc or hockey puck shaped devices. The MOVs of the present invention can be connected in electrical series with one or more thermal and/or transient fuses to give added advantages over an MOV in isolation. Such configurations and their advantages are described in more detail below.

DETAILED DESCRIPTION OF THE PREFERRED AND ALTERNATIVE EMBODIMENTS

Figure 1:
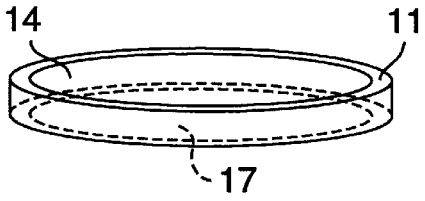
FIG. 1 PRIOR ART
FIG. 1 is a perspective view of a disc shaped MOV of the prior art.
Figure 2:
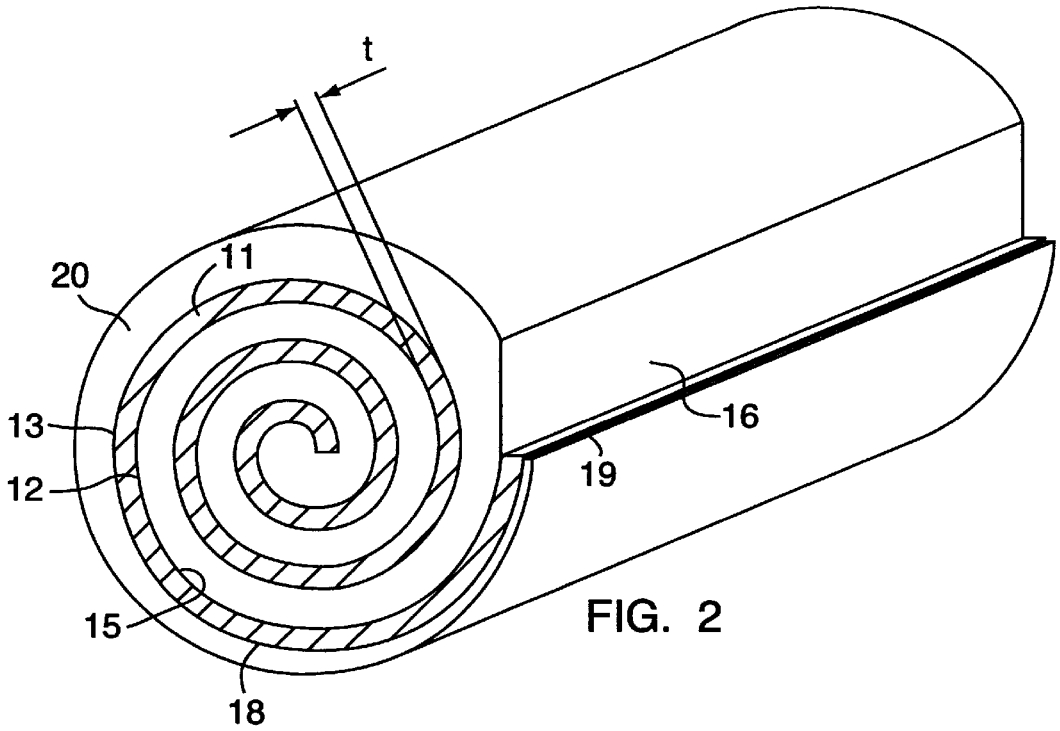
FIG. 2 is a perspective view of the preferred embodiment showing Spirals of Archimedes.

In the preferred embodiment shown in FIG. 2, the spiral characteristic of the major surfaces is evident on the circular face of the cylindrical MOV device. The ceramic substrate 11 has a first major surface 12 and a second major surface 13, each forming a Spiral of Archimedes having a finite thickness (t). A first conductive coating 15 is disposed on and substantially covers the interior portions of the first major surface 12. The first conductive coating 15 is in electrical contact with a first electrode and a first connection means 16 for electrical connection to an external electrical circuit, transient fuse, thermal fuse, or another device. The first connection means is shown in FIG. 2 as a conductive plate 16 having a resilient prong (not shown) for an electrical connection to a parent circuit. Alternatively, first connection means 16 may comprise a protruding pin or tab for insertion into a receptacle; a receptacle to receive an external pin, plate, or tab; or any of the variety of other electrical connection means well known in the electrical arts.

A second conductive coating 18 is disposed on and substantially covers the second major surface 13. A second electrode is in electrical communication with the second conductive coating 18 and comprises a second connection means 19 for electrically connecting to an external electrical circuit or device. The second connection means 19 (not shown in FIG. 2) may also comprise a conductive plate (albeit narrower than the first connection means 16), but may instead be any of the connection means described above. The first and second electrodes are in electrical communication with the first 12 and second 13 major surfaces, respectively, through the respective first 15 and second 18 conductive coatings.

The substrate 11 has a thickness (t) that is near, but not necessarily, constant through the major portions of these surfaces 12 and 13. That is, the distance between the first and second major surfaces 12 and 13 through the substrate 11 is substantially constant. Certain applications may employ an area of lesser substrate thickness to control upturn and overshoot, as described in U.S. Pat. No. 4,157,527, as well as variations in breakdown and clamping voltages. The substrate 11 spirals in such a fashion that the first and second major surfaces 12 and 13 do not contact each other, but define a spiral cavity. This spiral cavity is filled with a substantially non-conductive material 20 to prevent electrical continuity, conduction, and arcing between the conductive coatings of the first and second major surfaces 12 and 13. The non-conductive material 20 is also shown extending beyond the cavity to substantially envelop the curved surfaces of the device. The flat circular end surfaces of the cylinder, such as the facing surface of FIG. 2, is also coated with a non-conductive coating (not shown) again to prevent electrical conduction and arcing between the electrode surfaces 12 and 13. The horizontal surface of the substrate 11 that is immediately between the first and second connection means 16 and 19 is also coated with a non-conductive coating to prevent arcing across this surface. The entire exterior surface of the cylinder may similarly be coated, but since the non-conductive material 20 envelops the curved cylindrical surfaces of the device, such a coating is not essential; its presence would primarily be a function of voltages expected to be applied to the device.

Figure 3:
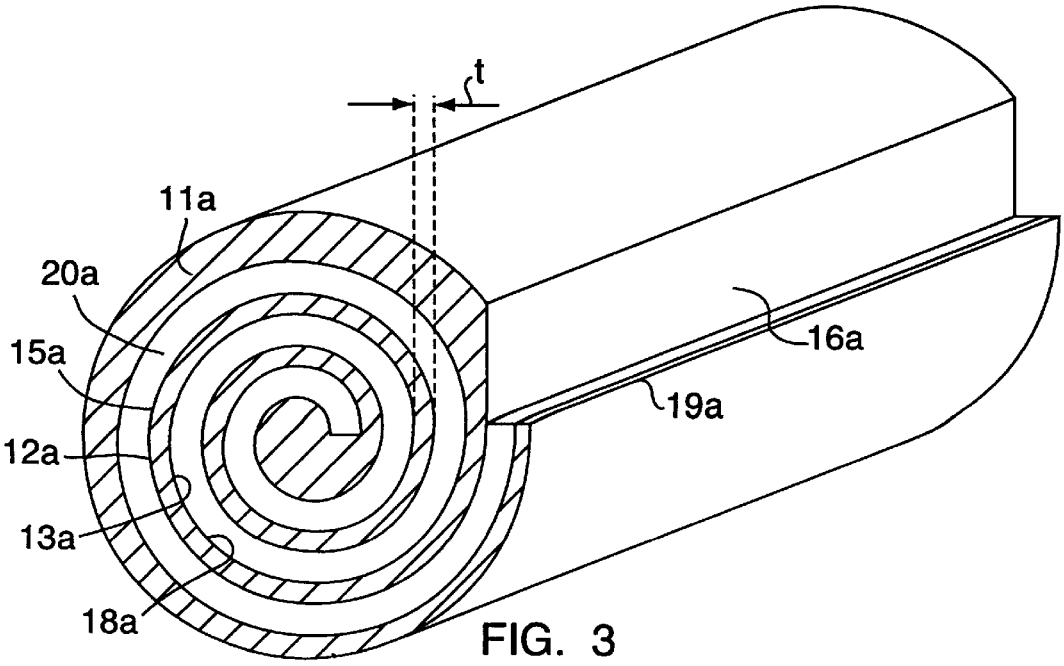
FIG. 3 is a perspective view of the alternative embodiment, wherein the relative positions of the ceramic and non-conductive material are reversed as compared to that in FIG. 2.

The alternative embodiment shown in FIG. 3 is similar to that in FIG. 2, except the positions of the ceramic substrate 11 and the non-conductive material 20 are reversed. Like numbers between figures indicate like components, with the subscript a designating components of FIG. 3. Of particular note in this variation is that the exterior surface of the cylinder is also the first major surface $\mathbf{12}_a$ of the substrate $\mathbf{11}_a$, whereas the exterior surface of the cylinder in FIG. 2 is a surface of the non-conductive material 20. Since the second connection means $\mathbf{19}_a$ shown in FIG. 3 is adjacent to the first major surface $\mathbf{12}_a$, care must be taken to preclude an unintended electrical pathway between the electrodes. Thus the portion of the first major surface $\mathbf{12}_a$ that constitutes the exterior surface of the cylinder in FIG. 3 is not covered with a conductive coating. Only the portions of the first major surface $\mathbf{12}_a$ that are internal or within the spiral envelope are coated with the first conductive coating. A non-conductive coating is preferably applied to the entire exterior surface of the cylinder of FIG. 3, excepting those portions of the first and second connection means $\mathbf{16}_a$ and $\mathbf{19}_a$ that will electrically contact surfaces $\mathbf{12}_a$ and $\mathbf{13}_a$ respectively, as well as exterior contacts, circuitry, or devices.

It will be obvious to those skilled in the art that the present invention substantially increases the surface area between the smallest electrode and the varistor substrate material, thus yielding an MOV with substantially greater current carrying capabilities per unit physical volume.

Figure 4:
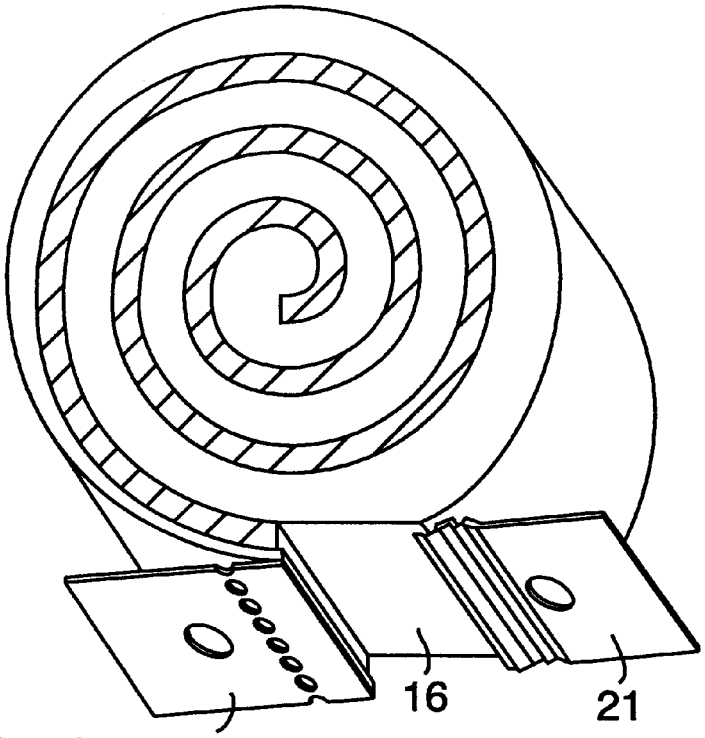
FIG. 4 is a drawing of the MOV of FIG. 2 in electrical series with both a thermal and a transient fuse, the MOV disposed therebetween. The connection of the MOV device in FIG. 3 to either a thermal and/or transient fuse is also apparent from this figure.

The MOVs described above may be configured in electrical series with one or more fuses, and the MOV of FIG. 2 is taken as an illustrative example. FIG. 4 depicts an MOV of the present invention in series with a thermal fuse and a transient fuse, wherein the MOV is disposed between these opposing fuses, but the order of this series arrangement is not essential. The MOV of the present invention can be alternatively configured with either of these fuses individually.

Figure 5:
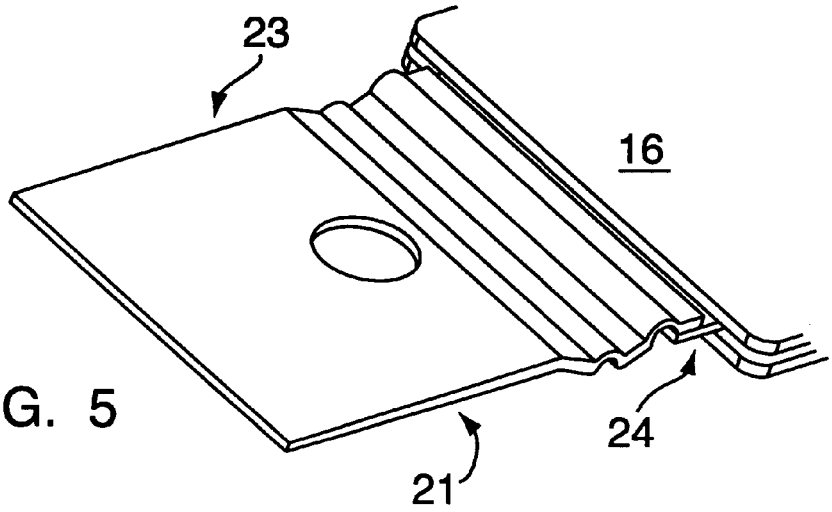
FIG. 5 is a detailed view of the thermal fuse of FIG. 4 in isolation.

The MOV in series with a thermal fuse 21 only, as depicted in FIG. 4, regardless of the presence of the transient fuse 22 gives the advantage of protecting the MOV from thermal runaway. A thermal fuse of any of the numerous types well known in the art is adapted to disconnect the MOV from the parent circuit immediately prior to or during the MOV experiencing thermal runaway. FIG. 5 depicts the thermal fuse 21 of FIG. 4 in isolation, wherein a spring loaded connector 23 for connecting to an external circuit or device is held to the first connection 16 of the MOV by means commonly known in the art, at a thermo sensitive junction 24. The thermo-sensitive junction may be completed by a solder alloy having a low melting temperature, which are well known in the art. Also well known in the art are transient fuses, and an MOV of the present invention is shown in series therewith in FIG. 4 regardless of the presence of the thermal fuse 21. The transient fuse 22 disconnects the MOV from the parallel circuit across which it is connected during periods of excessive current. While the MOV's of the present invention exhibit substantially greater current carrying capabilities over the prior art, certain electrical events such as a surge associated with a lightning strike may still cause an over-current condition. During these instances, the transient fuse 22 physically interrupts current through the MOV and prevents its complete and catastrophic destruction. FIG. 4 taken in whole shows the MOV of FIG. 2 in electrical series with a thermal fuse 21 and a transient fuse 22 wherein the MOV is disposed between these opposing fuses, but the order of this series arrangement is not essential, and thereby gains each or a combination of the advantages described above.

While the preferred embodiment and several variations have been shown and described, additional various modifications and substitutions will be apparent to those skilled in the art and may be made without departing from the spirit and scope of the present invention. The embodiments described above are hereby stipulated as illustrative rather than exhaustive.

I claim:

1. A metal oxide varistor assembly comprising:

an elongated ceramic substrate having first and second major spiral surfaces spaced apart radially by the dimension (t);

a first electrode in electrical contact with said first major surface;

a second electrode in electrical contact with said second major surface; and a said substrate surfaces defining a spiral cavity of radial dimension equal to or greater than said radial spacing (t) between said first and second major surfaces, a substantially nonconductive material disposed in said spiral cavity, and filling said spiral cavity and also defining a cylindrical external casing for said ceramic substrate, and covering an outermost spiral major surface, thereby providing an insulative coating surrounding the outermost electrode of said first and second electrodes which is provided on said outermost major spiral surface.

2. The assembly of claim 1 wherein the distance (t) between said first and second major surfaces through said substrate is substantially constant through a major portion of said spiral shaped substrate.

3. The assembly of claim 1 further comprising a first conductive coating disposed on said first major surface, and a second conductive coating disposed on said second major surface.

4. The assembly of claim 3 wherein said first and second electrodes each further comprise means to removably connect to an external electrical circuit or device.

5. The assembly of claim 1 further including a thermal electrical fuse connected in electrical series with said outermost electrode of said first or second electrodes.

6. The assembly of claim 1 further including a transient electrical fuse connected in electrical series with said outermost electrode of said first or second electrodes.

7. The assembly of claim 1 further including at least one thermal electrical fuse and transient electrical fuse connected in electrical series with said outermost electrode of said first and second electrodes respectively.

* * * * *